United States Patent [19]

Goossens

[11] Patent Number: 4,517,416

[45] Date of Patent: May 14, 1985

[54] ELECTRO-ACOUSTIC TRANSDUCER HAVING A DIAPHRAGM COMPRISING A LAYER OF POLYMETHACRYLIMIDE FOAM

[75] Inventor: Urbanus P. M. Goossens, Dendermonde, Belgium

[73] Assignee: U.S. Philips Corporation, New York, N.Y.

[21] Appl. No.: 467,539

[22] Filed: Feb. 17, 1983

[30] Foreign Application Priority Data

Feb. 22, 1982 [NL] Netherlands ..... 8200690

[51] Int. Cl.[3] ..... H04K 1/24; H04K 1/28; H04K 7/00

[52] U.S. Cl. ..... 179/115.5 PS; 179/116; 179/181 R; 179/181 F; 179/180; 181/144; 181/146; 181/163; 181/167

[58] Field of Search ..... 179/115.5 PS, 115.5 R, 179/116, 181 F, 181 R, 180; 181/144, 146, 163, 167, 170; 428/473.5, 474.4

[56] References Cited

U.S. PATENT DOCUMENTS

| | | | |
|---|---|---|---|
| 3,172,498 | 3/1965 | Gönke | 181/167 |
| 3,350,513 | 10/1967 | Roberts | 181/167 |
| 4,410,768 | 10/1983 | Nakamura et al. | 179/115.5 R |

FOREIGN PATENT DOCUMENTS

| | | | |
|---|---|---|---|
| 55-11680 | 1/1980 | Japan | 179/116 |
| 57-72496 | 5/1982 | Japan | 179/181 R |
| 2053718 | 11/1982 | Japan | 179/115.5 R |
| 1275158 | 5/1972 | United Kingdom | 181/170 |
| 1384716 | 2/1975 | United Kingdom . | |

*Primary Examiner*—Gene Z. Rubinson
*Assistant Examiner*—Danita R. Byrd
*Attorney, Agent, or Firm*—Robert T. Mayer; Bernard Franzblau

[57] ABSTRACT

An electro-acoustic transducer has a diaphragm which comprises a layer of a polymethacrylimide foam having a modulus of elasticity between $15\times10^6$ and $120\times10^6$ $N/m^2$ and a density between 10 and 80 $kg/m^3$. If the diaphragm has a sandwich construction, the core layer is made of said polymethacrylimide foam and the skin layers are made of glass fibres, carbon fibres, cellulose fibres or polyaramide fibres. This results in a transducer having a higher efficiency and a lower distortion.

23 Claims, 5 Drawing Figures

Figure 1:
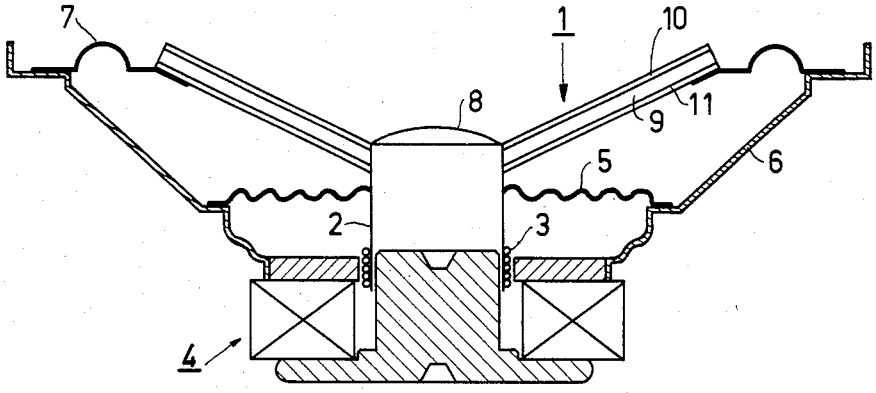

ELECTRO-ACOUSTIC TRANSDUCER HAVING A DIAPHRAGM COMPRISING A LAYER OF POLYMETHACRYLIMIDE FOAM

The invention relates to an electro-acoustic transducer having a diaphragm. Such a transducer is known from British Patent Specification No. 1,384,716. In that Patent Specification it is proposed that a foamed thermoplastic material, such as, for example, polystyrene foam, polyurethane foam, phenolic-resin foam or the like, be used as a diaphragm material for cones. There are also other publications which propose the use of specific foamed materials for diaphragms with a sandwich construction, the diaphragm comprising a core layer and two skin layers which are each arranged on one of the major surfaces of the core layer. An example of this is described in U.S. Pat. No. 4,198,550 which concerns flat and conical diaphragms whose core layers consist of a polystyrene foam.

It has been found that in transducers in which the material of the diaphragm is one of the known foamed diaphragm materials, the transducer performance is far from optimum. For example, the electro-acoustic conversion efficiency is inadequate and it is found that especially at higher frequencies the transducer signal is distorted.

It is an object of the invention to improve the transducer efficiency, to reduce the distortion and shift it towards higher frequencies and to obtain a flat frequency response of the transducer over a wider frequency range. To this end an electro-acoustic transducer having a diaphragm is characterized in that the diaphragm comprises a layer of polymethacrylimide foam having a modulus of elasticity between $15\times10^6$ and $120\times10^6 N/m^2$ and a density between 10 and 80 $kg/m^3$. When the diaphragm has a sandwich construction comprising a core layer and first and second skin layers, which skin layers are each arranged on one of the two major surfaces of the core layer, the core layer is made of a polymethacrylimide foam having a modulus of elasticity and a density between the respective limits specified above.

The invention is based on the discovery that an optimum choice of a diaphragm material is mainly dictated by the parameters E, which is the modulus of elasticity [$N/m^2$], and $\rho$, which is the density [$kg/m^3$]. These parameters first of all determine the frequency at which and above which the diaphragm breaks up (the so-called "break-up" frequency). This break-up frequency is proportional to $\sqrt{E/\rho}$. "Breaking-up" means that the diaphragm vibrates in a natural resonance mode (at increasing frequency starting with the lowest natural resonant frequency). This means that the diaphragm no longer vibrates in phase over the entire surface area. This gives rise to resonance peaks in the frequency response curve. As a result of this the transducer signal (the radiated sound in the case of loudspeakers) will exhibit a high distortion. Therefore, the factor $\sqrt{E/\rho}$ should be as high as possible in order to obtain a maximum frequency range in which the transducer operates without breaking up and consequently without any significant distortion. Secondly the parameters E and $\rho$ determine the quality factor of the said resonance peaks. The quality factor is proportional to $\sqrt{E\rho}$. The quality factor is also a measure of the degree of oscillation of the system—that is the height of the resonance peak. In view of the foregoing it will be evident that the quality factor should be minimized in order to minimize the resonance peaks and consequently the distortion components in the transducer output signal. Moreover, the density $\rho$ is a measure of the weight of the diaphragm and thus of the electro-acoustic conversion efficiency. The efficiency increases as the density (and consequently the weight) decreases. Briefly summarized, the optimum choice of a diaphragm material is determined by the following requirements:

(a) a maximal modulus of elasticity E and (b) a minimal density $\rho$.

This results in a maximal factor $\sqrt{E/\rho}$, which is desirable for the break-up, and a minimal weight which is desirable from the point of view of efficiency. Moreover, the quality factor then will not be too high so that the resonance peaks will not be too high.

The proposed material, polymethacrylimide foam, is the only plastic foam which combines the property of a high modulus of elasticity with the property of a low density, so it is extremely suitable as a material for a diaphragm, or the core layer of a diaphragm, for an electro-acoustic transducer.

In the foregoing the conclusion has been drawn that the optimum choice of a diaphragm material is dictated by, inter alia, the requirement that the density $\rho$ should be minimal. From this requirement it could be inferred that it suffices to specify only the upper limit in order to characterize the polymethacrylimide foam in the transducer in accordance with the invention. Nevertheless, a lower density limit also is specified. This lower limit is specified in view of the mechanical stability and strength of the plastics foam during the manufacturing process. If the density is too low (or if the degree of foaming is excessive, as will be explained later herein) the mechanical stability and strength of the foam is inadequate, so that the material cannot retain its external shape and collapses. For polymethacrylimide foam the limit above which dimensionally stable diaphragms can be obtained corresponds to a density of approximately 10 $kg/m^3$.

The following Table 1 specifies the values for the moduli of elasticity E of a number of rigid plastic foams (including polymethacrylimide foam) as a function of their densities. The densities are selected within the range claimed for the present invention, namely, between 10 and 80 $kg/m^3$. The data in the Table are partly obtained by measurements and are partly taken from the publication: "Plastic foams, Physics and Chemistry of product performance and process technology" by Calvin J. Benning-Wiley Interscience. The values specified in Table 1 should be multiplied by $10^6$ in order to obtain the correct values for the various moduli of elasticity.

TABLE 1

| type of foam | density [$kg/m^3$] 15 | 30 | 50 | 75 | |
|---|---|---|---|---|---|
| polymethacrylimide foam | 20 | 35 | 70 | 100 | E |
| expanded polystyrene foam | 6 | 8 | 12 | 18 | E |
| rigid polyurethane foam | — | 3.5 | 5 | 10 | E |
| epoxy foam | — | 3.5 | 6 | 12 | E |
| polypropylene foam | — | — | — | 7 | E |
| phenolic-resin foam | — | 2.5 | 5 | 10 | E |

Moduli of elasticity (E) of some rigid plastic foams (in $10^6$ $N/m^2$ and at 20° C.) for a number of densities.
— means that no data available.

The degree of foaming of the various materials influences both the modulus of elasticity and the density of the material. A higher degree of foaming results in a reduced density which, as is apparent from the foregoing, is desirable. A higher degree of foaming, however, also reduces the modulus of elasticity of the material (see Table 1), which is not desirable in view of the foregoing. The frequency range in which breaking-up takes place is then shifted toward lower frequencies. As a result of these two conflicting phenomena, it is generally not possible to vary the degree of foaming so as to bring both parameters within the desired ranges. This is evident from Table 1. For polymethacrylimide foam the moduli of elasticity at the various densities are all within the range claimed for the present invention, namely, between $15\times10^6$ and $120\times10^6 N/m^2$. For the other materials in the Table this is not true in (nearly) all cases. The modulus of elasticity in these cases is (nearly) always below the lower limit of $15\times10^6 N/m^2$ of the claimed range. As a result, the factor $\sqrt{E/\rho}$ for these materials in nearly all these cases is smaller than that for the polymethacrylimide foam, which means that the use of these materials for diaphragms in electro-acoustic transducers would result in transducers having a limited operating frequency range and a high distortion. Only the polymethacrylimide foam can be foamed in such a way that both parameters are within the limits claimed. This yields a transducer having a wide operating frequency range, a high efficiency and a low distortion. For the expanded polystyrene foam with a density of 75 $kg/m^3$ and a modulus of elasticity of $18\times10^6 N/m^2$ it is to be noted that this foam also falls within the limits claimed. However, the expanded polystyrene foam is not attractive in comparison with the polymethacrylimide foam as will be apparent from a comparison of the factors $\sqrt{E/\rho}$ and $\sqrt{E\rho}$ of the two materials.

TABLE 2

| | E | $\rho$ | $\sqrt{E/\rho}$ | $\sqrt{E\rho}$ |
|---|---|---|---|---|
| polymethacrylimide foam | $20\times10^6$ | 15 | $1.2\times10^3$ | $17.3\times10^3$ |
| expanded polystyrene foam | $18\times10^6$ | 75 | $0.5\times10^3$ | $36.7\times10^3$ |

TABLE 3

| | E | $\rho$ | $\sqrt{E/\rho}$ | $\sqrt{E\rho}$ |
|---|---|---|---|---|
| polymethacrylimide foam | $100\times10^6$ | 75 | $1.2\times10^3$ | $86.6\times10^3$ |
| expanded polystyrene foam | $18\times10^6$ | 75 | $0.5\times10^3$ | $36.7\times10^3$ |

In Tables 2 and 3 the polystyrene foam is compared with a polymethacrylimide foam for which $E=20\times10^6 N/m^2$ and $\rho=15\ kg/m^3$ (Table 2) and with a polymethacrylimide foam for which $E=100\times10^6 N/m^2$ and $\rho=75\ kg/m^3$ (Table 3). It is found that in both cases the lower limit of the break-up region is situated at a frequency which is a factor 2.4 higher (and hence more favourable) for the polymethacrylimide foam. Moreover, in the first case (Table 2) the quality factor for polymethacrylimide foam is more favourable (lower): the ratio is 1:2.1 in favour of the polymethacrylimide foam. Moreover, the density is substantially lower so that the efficiency is substantially higher. In the second case (Table 3) however the quality factor for polystyrene foam is more favourable. However, also in this second case polymethacrylimide foam will be preferred since the factor $\sqrt{E/\rho}$ (and thus the break-up frequency) is more important than the factor $\sqrt{E\rho}$. This is because of the fact that at the upper end the operating frequency range of the transducer is dictated by the first break-up frequency, while an excessive resonant peak can always be suppressed by a low-pass filter which is arranged before—and in series with—the transducer and whose cut-off frequency is slightly lower than the break-up frequency.

If the diaphragm is of a sandwich construction the skin layers may be made of glass fibres, carbon fibres, cellulose fibres or polyaramide fibres. These skin layers additionally increase the rigidity of the diaphragm and contribute relatively little to the weight of the diaphragm.

Moreover, since such skin layers are permeable to air, they have the advantage that when they are glued to the core layer by means of a glue dissolved in a solvent, the solvent can subsequently evaporate to the exterior through the pores in the skin layers. The layer of glue does not contribute significantly to the weight of the diaphragm. Said skin layers may be employed because the polymethacrylimide foam of the core layer has a closed cell structure, that is to say, the core layer is impermeable to air.

A further embodiment of the electro-acoustic transducer in accordance with the invention is characterized in that at least one of the skin layers is impermeable to air and the core layer is formed with perforations. By forming perforations in the core layer the weight of the diaphragm can be reduced even further. Yet another embodiment of the electro-acoustic transducer in accordance with the invention is characterized in that the diaphragm is a flat diaphragm and is connected via at least one auxiliary cone to a voice-coil former on which a voice coil is arranged.

When the transducer functions as a loudspeaker, the flat diaphragm is preferably excited at the first nodal line. This line is the collection of points on the diaphragm surface where the diaphragm excursion is zero for the first natural resonant frequency. Then the first natural resonance of the diaphragm is not generated so that the frequency response of the transducer remains flat over a wider frequency range. In the case of a flat diaphragm comprising a single layer of a polymethacrylimide foam, driving the diaphragm may be effected by means of two or more auxiliary cones. A single-layer diaphragm of polymethacrylimide foam is less rigid than a diaphragm of the same thickness having a sandwich construction in which the core layer is made of polymethacrylimide. By exciting the diaphragm via two or more auxiliary cones the lack of rigidity of a single-layer diaphragm, as compared with a sandwich construction, is in effect compensated for, so that it is possible to use a single-layer diaphragm for a flat-diaphragm transducer with a sufficiently wide and flat frequency characteristic. It is to be noted that in the case of driving by means of two or more auxiliary cones the "nodal" drive is not strictly necessary.

In the case of excitation via one or more auxiliary cones the movement of the auxiliary cone(s) is transmitted to the diaphragm via an elastic damping element. By arranging an elastic damping element between an auxiliary cone and the flat diaphragm (or between the voice-coil former and the flat diaphragm if the diaphragm is excited directly), it is achieved that the second and higher natural resonant frequencies of the diaphragm, which are generated by the excitation, are strongly damped so that in this case too the flat portion of the frequency response curve of the transducer is widened. Yet another embodiment of the device in accordance with the invention is characterized in that the diaphragm is of a sandwich construction comprising a core layer and first and second skin layers, and in that the core layer is made of a polymethacrylimide foam and is formed with corrugations which extend in the plane of the diaphragm and is provided with ribs of a light metal, which ribs extend in the plane of the diaphragm in directions perpendicular to said corrugations and lie in planes perpendicular to the diaphragm surface. This results in a rigid diaphragm which is very light in weight, which substantially increases the transducer efficiency.

Figure 2:
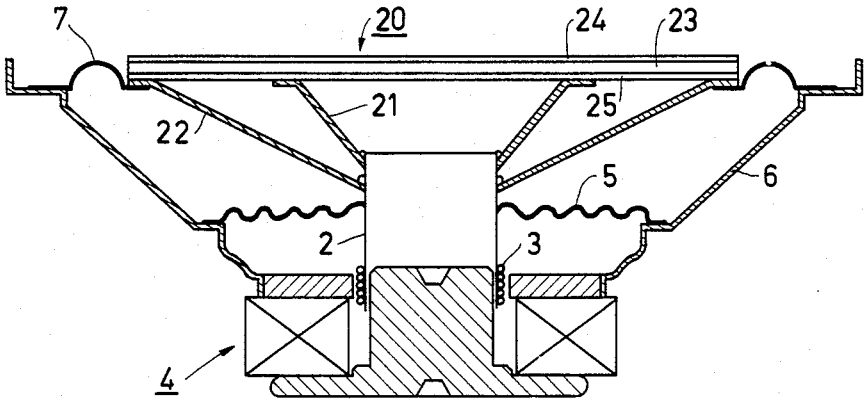
Figure 3:
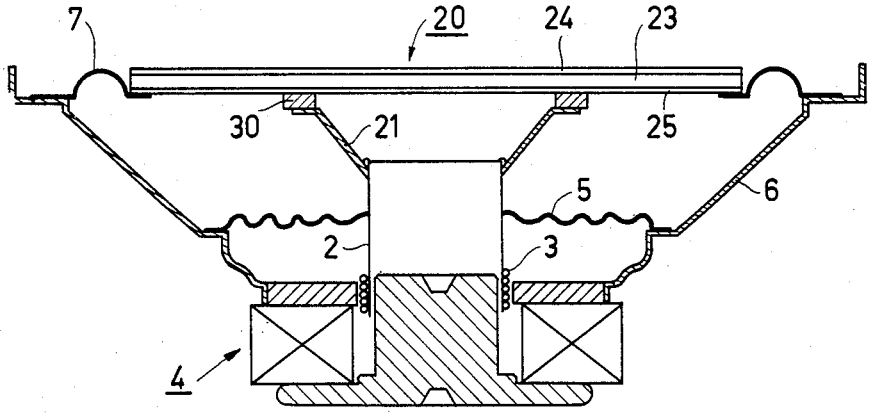
Figure 4:
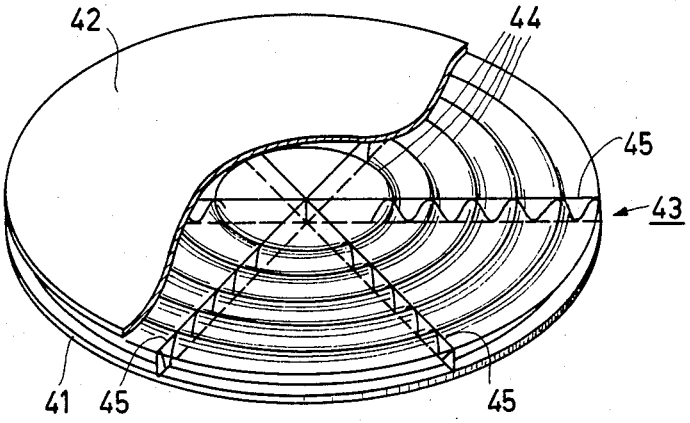
Figure 5:
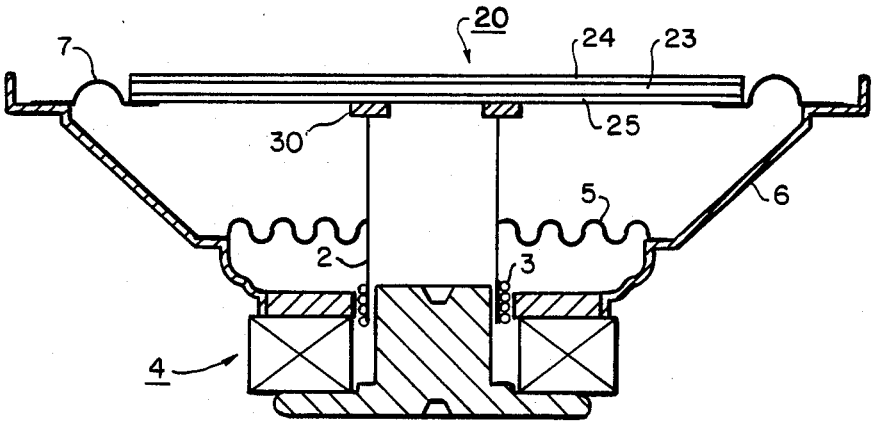

Embodiments of the transducer in accordance with the invention will now be described in more detail, by way of example, with reference to the drawings. In the drawings:

FIG. 1 is a sectional view of a first embodiment of the transducer having a cone-shaped diaphragm, FIG. 2 is a sectional view of a second embodiment in which the diaphragm is flat, FIG. 3 is a sectional view of a third embodiment in which the diaphragm is again flat, FIG. 4 is a perspective view of the diaphragm of yet another embodiment, and FIG. 5 is a sectional view of a further embodiment of the invention.

FIG. 1 shows a transducer in accordance with the invention in a sectional view. The transducer is a voice-coil loudspeaker comprising a cone-shaped diaphragm 1. At its inner rim the diaphragm is connected to a voice-coil former 2 on which a voice coil 3 is arranged. The voice-coil former, with the voice coil, can move in a gap formed in a magnet system 4. The construction of the magnet system is conventional and requires no further explanation because the invention is not directed to the magnet system. Consequently, the invention is not limited to transducers whose magnet system is constructed in exactly the same way as is shown in FIG. 1. The voice-coil former 2 is secured to the loudspeaker chassis 6 via a spider 5. The outer rim of the diaphragm 1 is also secured to the loudspeaker chassis 6 via a centering ring 7. The voice-coil former is closed by a dust cap 8. The diaphragm may comprise a layer of a polymethacrylimide foam having a modulus of elasticity between $15\times10^6$ and $120\times10^6 N/m^2$ and a density between 10 and 80 $kg/m^3$. Alternatively, the diaphragm 1 may be of a sandwich construction. The latter possibility is illustrated in FIG. 1. The diaphragm 1 comprises a core layer 9 and first and second skin layers 10 and 11 which are each arranged on a major surface of the core layer. The core layer is made of a polymethacrylimide foam having a modulus of elasticity and density within the respective ranges specified above.

The skin layers may be manufactured from materials which are generally known from the relevant literature. Suitably, the skin layers will be made of glass fibres, carbon fibres, cellulose fibres or polyaramide fibres. This choice has a number of advantages.

1. In such a sandwich construction the skin layers are very light in weight because of their fibre structure. The weight of the diaphragm is therefore mainly determined by the density of the polymethacrylimide foam. Consequently the skin layers do not contribute significantly to the weight of the moving part.
2. In such a sandwich construction the skin layers are very strong. The rigidity of the sandwich construction is mainly determined by the rigidity of the skin layers so that a very rigid diaphragm is obtained.
3. The skin layers are glued to the core layer. Since the skin layers have a fibre structure it is possible to glue them with a glue dissolved in a solvent. After gluing, during drying, the solvent can evaporate to the exterior via the pores in the skin layers. This results in a very light layer of glue which does not contribute significantly to the weight of the diaphragm. Preferably a woven fabric of the above-mentioned fibre is used, the weaving pattern of the fabric having at least a hexagonal structure. In that case, the elastic properties of the fabric are isotropic in the plane of the fabric.

The diaphragm 1 shown in FIG. 1 may be of a further construction in which it again has a core layer 9 of polymethacrylimide foam. In this construction the skin layers 10 and 11 also are made of polymethacrylimide, but it is not, or not significantly, foamed. Such a diaphragm may, for example, be obtained in the following manner. A layer of polymethacrylimide foam suitable for the core layer but having a greater thickness than is necessary for this layer is compressed at high temperature. Under the influence of the high temperature the layer of polymethacrylimide foam will soften at its lower and upper surfaces and as a result of the compression it will be depressed slightly at these surfaces. As a result of this, the inner portion of the layer will still consist of foamed polymethacrylimide whereas the upper and lower portions, as a result of the softening and compression, will consist of polymethacrylimide which is not, or not significantly, foamed. The softening and compression method as described in the foregoing may, for example, be effected in one step at the same time that the material is pressed into the desired conical shape. Consequently, this method of manufacture is very cheap and does not take much time because it is no longer necessary to provide separate skin layers for (and which need to be glued to) the core layer. Further, reference is made to techniques which are known per se for obtaining this so-called structure foam or integral foam.

FIG. 2 shows a second embodiment. Parts in FIGS. 1 and 2 having the same reference numerals are identical. This embodiment is an electro-acoustic transducer in the form of a moving-coil loudspeaker having a flat diaphragm 20. The diaphragm can be driven in various ways. A first possibility (not shown) is to extend the voice-coil former 2 up to the diaphragm surface and to transmit movement directly from the voice-coil former to the diaphragm 20. A second possibility is to arrange an auxiliary cone, such as the cone 21 in FIG. 2, between the voice-coil former and the diaphragm 20 to transmit movement from the voice-coil former to the diaphragm. In both embodiments the connection between the diaphragm and the voice-coil former or the auxiliary cone, as the case may be, is disposed at the location of the first nodal line of the diaphragm, thereby precluding the generation of the first natural resonant frequency of the diaphragm. A third possibility is to transmit the movement via two or more auxiliary cones, such as the cones 21 and 22 in FIG. 2. In that case the connections between the auxiliary cones and the diaphragm 20 need no longer extend along a nodal line. The diaphragm 20 may comprise a single layer of polymethacrylimide foam or may be of a sandwich construction, as shown in the drawing, the core layer 23 being made of polymethacrylimide foam and the skin layers 24 and 25 preferably being made of glass fibres, carbon fibres, cellulose fibres or polyaramide fibres.

If a single-layer diaphragm is chosen, i.e. one comprising a single layer of polymethacrylimide foam, the movement is transmitted from the voice-coil former to the diaphragm via two or more auxiliary cones 21, 22. This is because the single-layer diaphragm is less rigid than a diaphragm with a sandwich construction of the same thickness, and consequently its behaviour less closely resembles that of a flat piston, which is in fact desirable for flat-diaphragm loudspeakers.

FIG. 3 shows a third embodiment. Parts in FIGS. 1, 2 and 3 bearing the same reference numerals are identical. Again a flat diaphragm 20 having a sandwich construction is shown. The movement is transmitted from the voice-coil former 2 to the diaphragm 20 by means of a single auxiliary cone 21. Between the auxiliary cone 21 and the diaphragm 20 an elastic damping element 30 is arranged. The diaphragm is now driven at the nodal line for the lowest natural resonant frequency of the diaphragm. However, higher natural resonant frequencies may then be excited, which is undesirable. By interposing the elastic damping element 30 these higher resonant frequencies are damped out strongly so they will not adversely affect the frequency response of the transducer. The elastic damping element may, for example, be a rubber tube.

A further step to reduce the weight of the diaphragm, at least when it has a sandwich construction, and thereby increase the transducer efficiency, is to form the core layer 9 or 23 with perforations. At least one of the skin layers (suitably the skin layer 10 or 24 respectively) should then be impermeable to air.

FIG. 4 shows the sound-radiating diaphragm of another embodiment of the electro-acoustic transducer in accordance with the invention. The diaphragm is of a sandwich construction having first and second skin layers 41 and 42 respectively between which a core layer 43 is arranged. The core layer 43 is made of polymethacrylimide foam and is formed with corrugations 44 which extend in the diaphragm plane. In a circular diaphragm the corrugations each extend along a circular path concentric with the diaphragm. In the case of a rectangular or square diaphragm they may, for example, extend in a direction parallel to one side of the diaphragm. Extending in the plane of the diaphragm in directions perpendicular to the corrugations, i.e. in radial directions (which are perpendicular to tangents to the corrugations) in the embodiment shown in FIG. 4, are ribs 45 which lie in planes perpendicular to the diaphragm surface, i.e. perpendicular to the skin layers, and which are, for example, made of a light metal such as aluminium. The modulus of elasticity and the density of the polymethacrylimide foam used are again between the limits $15\times10^6$ and $120\times10^6 N/m^2$ and between 10 and 80 $kg/m^3$ respectively. In order to prevent Helmholtz resonances from being excited in the cavities between the core layer and the skin layers, the skin layers are preferably made of a material which is impermeable to air. This diaphragm is very light in weight, which guarantees a high transducer efficiency. Again the diaphragm may be driven directly by the voice-coil former or via one or more auxiliary cones. Alternatively, the elastic damping element shown in FIG. 3 may be used.

FIG. 5 shows a sectional view of a transducer in accordance with the invention wherein a flat diaphragm 20 of sandwich construction is driven directly by the voice-coil former 2 via an elastic damping element 30.

It will be appreciated that the invention is not limited to the embodiments shown. The invention also relates to electro-acoustic transducers which differ from the embodiments shown as regards features which do not relate to the inventive concept. For example, the invention not only relates to transducers in the form of loudspeakers but also to transducers in the form of microphones.

What is claimed is:

1. A diaphragm for an electro-acoustic transducer which comprises a layer of a polymethacrylimide foam having a modulus of elasticity between $15\times10^6$ and $120\times10^6 N/m^2$ and a density between 10 and 80 $kg/m^3$.

2. A diaphragm as claimed in claim 1 wherein the diaphragm comprises a sandwich configuration including a core layer and first and second skin layers secured to first and second opposed major surfaces of the core layer, the core layer comprising said layer of polymethacrylimide foam.

3. A diaphragm as claimed in claim 1 wherein the modulus of elasticity (E) is in the range between $20\times10^6$ and $100\times10^6$ $N/m^2$, the density ($\rho$) is in the range between 15 and 75 $kg/m^3$, and the factor $\sqrt{E/\rho}$ is approximately $1.2\times10^3$.

4. An electro-acoustic transducer comprising:

a chassis, a magnet system having an air gap and supported by the chassis, a voice-coil former with a voice-coil arranged thereon and movably supported within said air gap, and a diaphragm coupled to the voice-coil former and the chassis, said diaphragm comprising a layer of polymethacrylimide foam having a modulus of elasticity between $15\times10^6$ and $120\times10^6$ $N/m^2$ and a density between 10 and 80 $kg/m^3$.

5. An electro-acoustic transducer as claimed in claim 4, wherein the diaphragm has a sandwich construction comprising a core layer and first and second skin layers, arranged on first and second major surfaces, respectively, of the core layer, the core layer being made of said polymethacrylimide foam.

6. An electro-acoustic transducer as claimed in claim 5, wherein the skin layers are made of glass fibres or carbon fibres.

7. An electro-acoustic transducer as claimed in claim 5, wherein the skin layers are made of cellulose fibres or polyaramide fibres.

8. An electro-acoustic transducer as claimed in claim 5, wherein at least one of the skin layers is impermeable to air and the core layer is formed with perforations.

9. An electro-acoustic transducer as claimed in claim 8 wherein the diaphragm is a flat diaghragm and is connected via at least one auxiliary cone to the voice-coil former.

10. An electro-acoustic transducer as claimed in claim 9 wherein the movement of the voice-coil former is transmitted by the auxiliary cone to the diaghragm via an elastic damping element.

11. An electro-acoustic transducer as claimed in claim 5 wherein the diaghragm is a flat diaghragm and is connected via at least one auxiliary cone to the voice-coil former.

12. An electro-acoustic transducer as claimed in claim 11 wherein the skin layers are chosen from the group of materials consisting of glass fibers, carbon fibers, cellulose fibers and polyaramide fibers.

13. An electro-acoustic transducer as claimed in claim 12 wherein the movement of the voice-coil former is transmitted by the auxiliary cone to the diaghragm via an elastic damping element.

14. An electro-acoustic transducer as claimed in claim 5 wherein the diaghragm is a flat diaghragm and is connected via at least one auxiliary cone to the voice-coil former and the movement of the voice-coil former is transmitted by the auxiliary cone to the diaghragm via an elastic damping element.

15. An electro-acoustic transducer as claimed in claim 5 wherein the diaghragm is a flat diaghragm and movement is transmitted from the voice-coil former to the diaghragm via an elastic damping element.

16. An electro-acoustic transducer as claimed in claim 4 wherein the diaphragm is a flat diaphragm and is connected via at least one auxiliary cone to the voice-coil former.

17. An electro-acoustic transducer as claimed in claim 16, wherein the movement of the voice-coil former is transmitted by the auxiliary cone to the diaphragm via an elastic damping element.

18. An electro-acoustic transducer as claimed in claim 16 wherein the auxiliary cone is connected to the diaphragm along a first nodal line of the diaphragm.

19. An electro-acoustic transducer as claimed in claim 4 wherein the diaphragm is a flat diaphragm and movement is transmitted from the voice-coil former to the diaphragm via an elastic damping element.

20. An electro-acoustic transducer as claimed in claim 4 wherein the diaphragm is of a sandwich construction comprising a core layer and first and second skin layers, and the core layer is made of the polymethacrylimide foam and is formed with corrugations which extend in the plane of the diaphragm and is provided with ribs of a light metal which extend in the plane of the diaphragm in directions perpendicular to said corrugations and lie in planes perpendicular to the diaphragm surface.

21. An electro-acoustic transducer as claimed in claim 20 comprising a flat diaphragm with the first skin layer on one major surface of the core layer and the second skin layer on the other major surface of the core layer.

22. An electro-acoustic transducer as claimed in claim 4 wherein the diaghragm is a flat diaghragm and is connected via at least one auxiliary cone to the voice-coil former and the movement of the voice-coil former is transmitted by the auxiliary cone to the diaghragm via an elastic damping element.

23. An electro-acoustic transducer as claimed in claim 4 wherein the diaphragm is a flat diaphragm directly coupled to the coil former via an elastic damping element whereby movement of the coil former is transmitted to the diaphragm via the damping element so as to damp out higher resonant frequencies of the diaphragm.

* * * * *